United States Patent [19]

Logsdon

[11] 4,453,279

[45] Jun. 12, 1984

[54] BATH RACK ASSEMBLY

[76] Inventor: Hartley Logsdon, 125 E. Lakewood, West Palm Beach, Fla. 33405

[21] Appl. No.: 452,029

[22] Filed: Dec. 22, 1982

[51] Int. Cl.[3] ..... A47K 3/00

[52] U.S. Cl. ..... 4/559; 4/605; 220/19

[58] Field of Search ..... 4/559, 570, 605, 628, 4/656, 657, 660, 661; 220/18, 19; 211/195, 126, 153, 134, 133

[56] References Cited

U.S. PATENT DOCUMENTS

| | | | |
|---|---|---|---|
| 724,252 | 3/1903 | Blackwood | 4/656 |
| 1,944,049 | 1/1934 | Weiler | 4/559 X |
| 2,659,491 | 11/1953 | Williams | 4/559 X |
| 3,239,850 | 3/1966 | Kiss | 4/559 |
| 4,033,461 | 7/1977 | Nevai | 4/656 X |
| 4,053,954 | 10/1977 | Chapman | 4/559 |
| 4,150,869 | 4/1979 | Hansen | 4/605 X |
| 4,189,056 | 2/1980 | Majewski | 220/19 X |

*Primary Examiner*—Henry K. Artis

*Attorney, Agent, or Firm*—Malin, Haley & McHale

[57] ABSTRACT

A bath rack assembly for use in a bath or shower stall in combination with a bath seat appliance to store and retain toiletries and bathing materials within reach of a person utilizing the bath seat appliance. The generally L-shaped bath rack assembly has an attachment bar which removably hooks onto the bath seat appliance and has a floor, back, and at least one retaining bar to retain the toiletries and bathing materials on the bath rack assembly. The floor and back of the rack assembly are generally porous to prevent retention of bathing water. A retaining bar is provided to provide attachment for a razor blade shaving device. A generally horizontal grid apparatus is attached to the retaining bar to provide storage position for a bar of soap.

14 Claims, 5 Drawing Figures

Fig. 1.
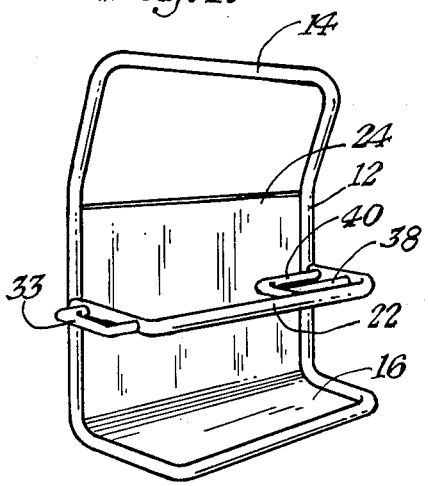
Fig. 2.
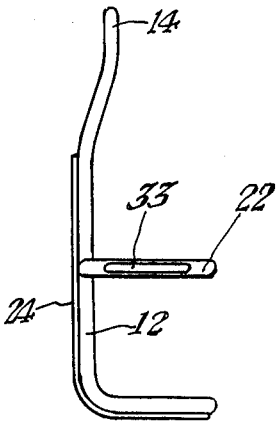
Fig. 3.
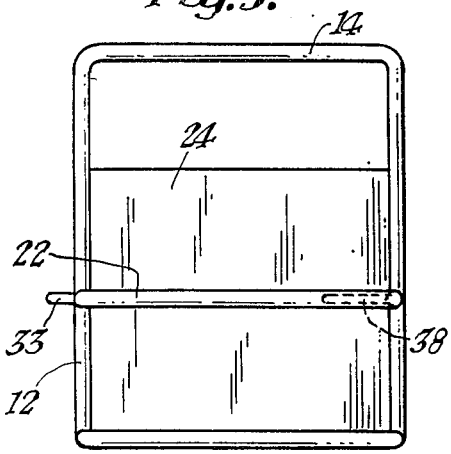
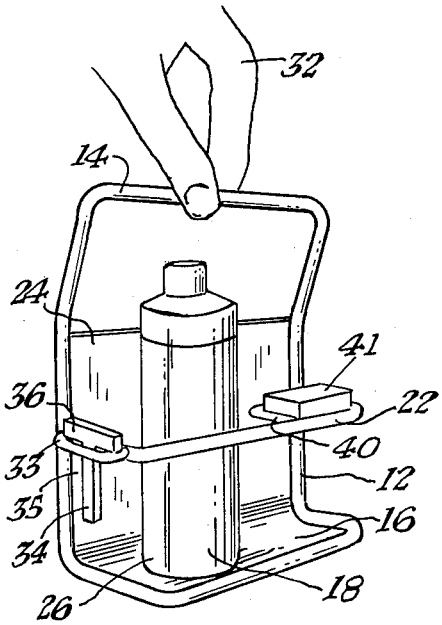
Fig. 4.
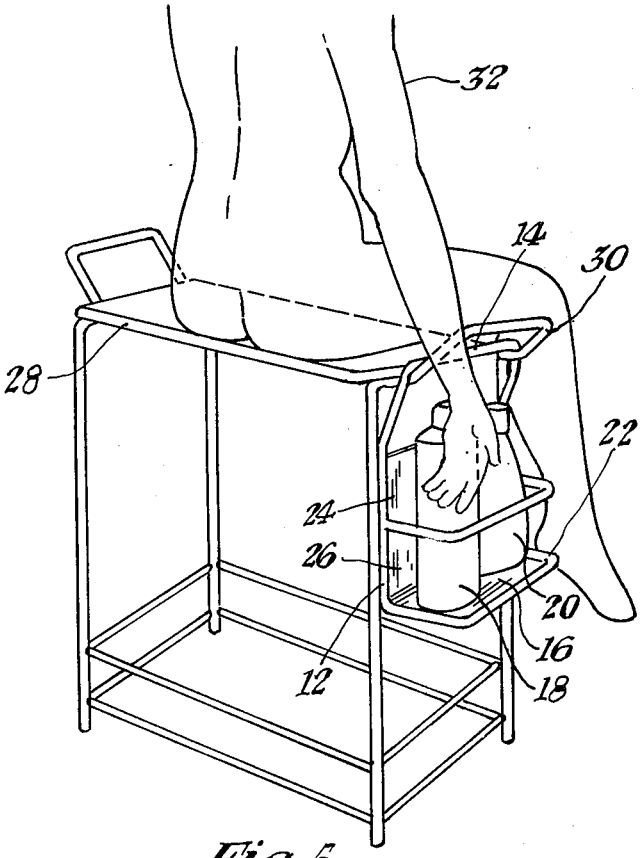
Fig. 5.

BATH RACK ASSEMBLY

BACKGROUND OF THE INVENTION

Elderly people who experience difficulty in standing in a shower or bath tub may utilize a bath seat appliance which supports them in a generally seated position. This requirement to sit restricts their movement about the bath or shower to require bathing materials such as toiletries and bathing materials such as shampoo, soap, washclothes, shaving creme, razors and other such materials for cleaning the body.

A need has arisen for a bath rack assembly which may easily attach to the bath seat appliance and retain the bathing materials within easy reach of the user.

BRIEF DESCRIPTION OF THE INVENTION

A bath rack assembly which is used to house and retain various articles for cleaning the body while utilizing a bath seat appliance in a shower or bath tub. The assembly has a generally L-shaped housing and attaches to the seat appliance by a hooking action of a slightly angular attachment bar. The assembly has a floor, backing, and at least one retention bar to retain various bathing articles and materials within reach of a bather situated on the seat appliance. The floor and backing are generally porous to prohibit the retention and build-up of bathing water. The general L-shaped construction of the assembly permits its placement on a level surface until utilization in combination with the seat appliance. A retaining loop stores a shaving device and a grid stores a bar of soap.

It is an object of this invention to provide a detachable support rack assembly for bathing materials.

It is another object of this invention to provide a support rack assembly for bathing materials for use in combination with a bath seat appliance.

It is yet another object of this invention to provide a support rack assembly which may be attached to the seating appliance by a hooking action of an attachment bar.

It is still another object of this invention to provide a porous support rack assembly for bathing materials.

It is yet another object of this invention to provide a support assembly having a means for retaining the bathing materials.

In accordance with these and other objects which will be apparent hereinafter, the instant invention will now be described with particular reference to the accompanying drawings.

BRIEF DESCRIPTION OF THE DRAWINGS

FIG. 1 shows a perspective view of the instant invention.

FIG. 2 shows a side elevational view of the instant invention.

FIG. 3 shows a front elevational view of the instant invention.

FIG. 4 shows a perspective view of the instant invention housing and retaining two containers of bathing material.

FIG. 5 shows a perspective view of the instant invention attached to a seating appliance and housing and retaining two containers of bathing material.

PREFERRED EMBODIMENT OF THE INVENTION

Referring now to the drawings, FIGS. 1, 2, 3 and 4, the instant invention is shown generally at 10 comprising a frame 12, attachment bar 14, floor 16, and a means for retaining bathing materials containers 18 and 20 such as at least one retaining bar 22 and back 24. Bath rack assembly 10 may utilize additional retaining bar 22 (not shown) in lieu of back 24 to retain containers 18 and 20. Retaining bar 22 is attached to frame 12 generally parallel to and above floor 16 a sufficient distance to prevent containers 18 and 20 from falling from assembly 10. Floor 16 is also attached to frame 12 in a generally horizontal position to provide vertical support to containers 18 and 20. Floor 16 is provided a means to prevent accumulation of bath water such as a plurality of openings 26 to permit drainage of bath water from the floor 16. Containers 18 and 20 are retained within a framework formed by floor 16, retaining bar 22 and back 24. Back 24 is attached to frame 12 to provide a barrier to horizontal movement of containers 18 and 20. Back 24 may also be provided a plurality of openings 26 to facilitate drainage of bath water. Bar 33 is connected to retaining bar 22 to provide an opening to insert the handle 34 of a razor blade shaving device 35. The head 36 impinging on the bar 33 to retain shaving device 35 for easy access to a bather. A generally rectangular grid 38 is comprised of a plurality of interconnected horizontal struts 40 to provide a generally horizontal surface with openings for storage of a bar of soap 41. The grid 38 is rigidly attached to retaining bar 22 and may also be attached to back 24 for additional vertical support.

FIG. 5 shows assembly 10 attached by overlapping connection to a bath seat appliance 28 having at least one upper armature 30. Attachment bar 14 is inserted over armature 30 to provide hanging support for assembly 10 so that containers 18 and 20 are within reach of a bather 32 shown seated on the seat appliance 28. Attachment bar 14 may be attached to frame 12 to provide an off-set, angular relationship between attachment bar 14 and frame 12 so as to cause assembly 10 to hang in a level position with floor 16 in a generally horizontal position when attached to armature 30. Bar 33 is shown with shaving device 35.

The instant invention has been shown and described herein in what is considered to be the most practical and preferred embodiment. It is recognized, however, that departures may be made therefrom within the scope of the invention and that obvious modifications may occur to a person skilled in the art.

What I claim is:

1. A bath rack assembly for housing and retaining the bathing materials of a bather for use in combination with a bather's bath seat appliance, comprising:

a means connected to said bath rack assembly for housing and retaining the bathing materials of a bather seated on the bath seat appliance;

an attachment means connected to said means for attaching said means to the bath seat appliance of a bather so that the bathing materials of the bather are within reach of the bather while seated on the bath seat appliance; and a draining means for providing for the drainage of bath water from said bath rack assembly, said drainage means connected to said means.

2. A bath rack assembly as recited in claim 1, wherein:

said bath rack assembly having a rubberized outer coating.

3. A bath rack assembly for housing and retaining the bathing materials of a bather for use in combination with a bather's bath seat appliance, comprising:

a frame means for storing and housing bathing materials of a bather seated on a bath seat appliance;

an attachment bar means connected to said frame means attaching said frame means to a portion of said bath seat appliance for placing the bathing materials within the reach of a bather seated on the bath seat appliance and for positioning a floor means in a generally horizontal position;

said floor means connected to said frame means for providing vertical support to the bathing materials; and a retaining means connected to said frame means retaining the bathing materials on said floor means to prevent the bathing materials from falling out of the bath rack assembly.

4. A bath rack assembly as recited in claim 3, wherein:

said retaining means includes a back structure and at least one generally horizontal retaining bar, said retaining bar connected to said frame means having a plane generally parallel to said floor means, said retaining bar situated sufficient distance above said floor means and said back structure connected to said frame means in a generally vertical position generally perpendicular to said floor means forming a restraining framework for one or more bathing materials.

5. A bath rack assembly as recited in claim 4, wherein:

said menas for preventing retention of bath water includes a plurality of openings in said floor means, said openings of sufficient size to permit draining of bath water from said bath rack.

6. A bath rack assembly as recited in claim 5, wherein:

said retaining means includes a horizontal grid of interconnected struts horizontally connected to said retaining bar, said grid having a horizontal surface plane to accommodate a bar of soap.

7. A bath rack as recited in claim 6, wherein:

said retaining means includes a loop connected to said retaining bar, said loop having an aperture accommodating a handle of a shaving device.

8. A bath rack assembly as recited in claim 7, wherein:

said attachment bar means includes an inverted generally U-shaped bar connected to said frame means at an angle providing off-set, overlapping connection with the bath seat appliance.

9. A bath rack assembly as recited in claim 8, wherein:

said bath rack assembly having a rubberized outer coating.

10. A bath rack assembly for housing and retaining the bathing materials of a bather for use in combination with a bather's seat appliance, comprising:

a generally L-shaped support frame assembly;

a flooring assmbly connected to a lower portion of said support frame in a generally horizontal position;

a backing assembly connected to an upper vertical portion of said support frame assembly in a generally vertical position;

an inverted, generally U-shaped attachment bar connected to said support frame assembly; and said support frame assembly, flooring assembly, and backing assembly forming a generally rectangular retaining framework.

11. A bath rack assembly as recited in claim 10, wherein:

said flooring assembly having a plurality of openings of sufficient size to permit the drainage of bath water from said bath rack assembly.

12. A bath rack assembly as set forth in claim 11, including:

a generally U-shaped portion horizontally connected to said support frame assembly accommodates the handle of a shaving device.

13. A bath rack assembly as set forth in claim 12, including:

a grid of interconnected horizontal struts connected to said support frame assembly having a generally horizontal plane surface to accommodate a bar of soap.

14. A bath rack assembly as recited in claim 13, wherein:

said bath rack assembly having a rubberized outer coating.

* * * * *